US011432660B1

(12) United States Patent
Lacy

(10) Patent No.: US 11,432,660 B1
(45) Date of Patent: Sep. 6, 2022

(54) RESILIENT AND BUOYANT BEANBAG CHAIR

(71) Applicant: Sean Lacy, Wilmington, NC (US)

(72) Inventor: Sean Lacy, Wilmington, NC (US)

( * ) Notice: Subject to any disclaimer, the term of this patent is extended or adjusted under 35 U.S.C. 154(b) by 0 days.

(21) Appl. No.: 17/592,110

(22) Filed: Feb. 3, 2022

(51) Int. Cl.
*A47C 27/08* (2006.01)
*A47C 15/00* (2006.01)

(52) U.S. Cl.
CPC ..... *A47C 27/086* (2013.01); *A47C 15/006* (2013.01)

(58) Field of Classification Search
CPC ..... A47C 15/006; A47C 27/086; A47C 7/14; A47C 7/142; A47C 3/16
See application file for complete search history.

(56) References Cited

U.S. PATENT DOCUMENTS 3,893,731 A * 7/1975 Maggs ..... A47C 27/086 D6/377
3,899,210 A * 8/1975 Samhammer ..... A47C 27/086 D6/377
3,965,506 A * 6/1976 Marks ..... A47C 7/18 297/452.17
4,027,888 A * 6/1977 Wilcox ..... A47C 27/086 297/452.17
4,601,667 A * 7/1986 Hull ..... A47C 4/54 297/DIG. 3
4,607,403 A * 8/1986 Alivizatos ..... A47D 15/003 5/636
4,667,356 A * 5/1987 Holmquist ..... A47D 13/08 5/655
5,279,237 A * 1/1994 Alivizatos ..... A47K 3/001 112/475.08
D351,525 S * 10/1994 Alexander ..... D6/601
D374,127 S * 10/1996 Diaz ..... D6/334
5,850,646 A * 12/1998 Turner ..... A47C 27/18 5/680
5,964,628 A * 10/1999 Scanlon ..... A47C 15/006 114/354
6,024,407 A * 2/2000 Eakin ..... A47C 3/16 5/915
6,234,577 B1 * 5/2001 Ruppert ..... A47C 3/16 297/452.17
7,614,362 B2 * 11/2009 Dunn ..... A01K 1/0353 5/643
7,708,342 B2 * 5/2010 Leach ..... A47C 7/0213 5/655.4
8,671,480 B1 * 3/2014 Leach ..... A47D 13/083 5/655

(Continued)

*Primary Examiner* — Kyle J. Walraed-Sullivan
(74) *Attorney, Agent, or Firm* — Dogwood Patent and Trademark Law; Ashley D. Johnson

(57) ABSTRACT

The invention is directed to a chair (e.g., beanbag chair) that can be easily and securely used in a home and an aquatic environment. The chair comprises a top panel that interacts directly with the user. Specifically, the top surface of the chair provides support for the user's back, rear end, and legs when in use. The chair also includes a pair of side panels, a front panel, a rear panel, and a bottom panel. The chair includes an interior filled with one or more materials (e.g., polystyrene). Advantageously, the chair is constructed from one or more resilient materials, providing increased durability and comfort for the user. In addition, the chair is configured to float on a body of water, such as the ocean, a lake, a swimming pool, or a river.

20 Claims, 8 Drawing Sheets

(56) References Cited

U.S. PATENT DOCUMENTS

D831,993 S * 10/2018 George, II ..... D6/375
10,206,514 B1 * 2/2019 Zivalich ..... A47C 3/16
10,687,629 B1 * 6/2020 Nelson ..... B29C 43/021
2002/0043869 A1 * 4/2002 Brook ..... A47C 4/54
297/452.41
2002/0184709 A1 * 12/2002 Berry, IV ..... A47C 27/086
5/655.4
2003/0151295 A1 * 8/2003 Nelson ..... A47C 3/16
297/452.17
2004/0117911 A1 * 6/2004 Rapisarda ..... A47C 31/123
5/655.4
2006/0145526 A1 * 7/2006 Niekel ..... A47C 3/16
297/452.14
2010/0200001 A1 * 8/2010 Randall ..... A47G 9/109
128/845
2013/0178124 A1 * 7/2013 Meinicke ..... A47C 27/081
441/129
2014/0265515 A1 * 9/2014 Harter ..... A47C 27/086
297/452.17
2015/0028632 A1 * 1/2015 McNae ..... A47C 16/02
297/130
2015/0035324 A1 * 2/2015 George, II ..... A47C 3/16
297/188.01
2015/0150380 A1 * 6/2015 Oh ..... B29C 44/1285
297/452.48
2015/0250328 A1 * 9/2015 Brechet ..... A47C 3/16
137/15.01
2016/0052607 A1 * 2/2016 Sosnowski ..... A44B 11/2592
441/129
2016/0309899 A1 * 10/2016 George, II ..... A47C 5/00
2017/0190392 A1 * 7/2017 Rubey ..... A63B 69/14
2020/0323369 A1 * 10/2020 Randall ..... A47G 9/109
2020/0375370 A1 * 12/2020 Choi ..... A61G 7/05738

* cited by examiner

RESILIENT AND BUOYANT BEANBAG CHAIR

TECHNICAL FIELD

The presently disclosed subject matter is generally directed to a beanbag chair that is resilient and resistant to damage, while also having the characteristic of being buoyant when positioned in a body of water.

BACKGROUND

Chairs come in a variety of forms and can include many different features. While a chair need not have legs, it generally provides back support, unlike a stool. The beanbag chair, popularized in the 1960's, is an example of such a chair. Typically, a beanbag chair includes sheets of inexpensive and flexible material sewn together to provide a generally spherical enclosure for a quantity of inexpensive, loose filling, beads (the "beans"). The chair is usually only filled with beads to about half its capacity, thereby giving the chair an amorphous shape. When a person sits on the beanbag chair, a depression readily forms, and the person is seated in the depression. Although the resultant body position may be comfortable, it can also be awkward, especially for an adult. Further, because beanbag chairs are typically formed from inexpensive materials, they are easily damaged during use (e.g., children playing, beverage spill, contact with sharp items). It would therefore be beneficial to provide a beanbag chair constructed from materials that convey increased comfort and durability to the chair. It would further be beneficial if the chair was buoyant and could be used in a wide variety of environments, such as the home, as well as the ocean, a lake, a swimming pool, and the like.

SUMMARY

In some embodiments, the presently disclosed subject matter is directed to a chair comprising a top panel and an opposed bottom panel, a pair of side panels that join the top and bottom panels, and a rear panel and an opposed front panel. The panels are joined together to define a fully enclosed chair with an interior, the interior filled with pellets. The front panel includes a portion of mesh defined by a series of apertures. The chair is buoyant and can float when in contact with a body of water.

In some embodiments, the chair is a beanbag chair.

In some embodiments, the top panel is configured to contact a user's body.

In some embodiments, the top panel and front panel are constructed from microfiber, cotton, nylon, polyester, wool, acetate, blends thereof.

In some embodiments, the top panel has a rectangular shape.

In some embodiments, each panel has a length of about 1-10 feet, a width of about 1-10 feet, and a thickness of about 0.1-1 inch.

In some embodiments, the bottom panel, rear panel, and side panels are constructed from Cordura®, nylon, canvas, polyester, Teflon®, polyamide, plastic, or combinations thereof.

In some embodiments, the apertures have a diameter of about 50-500 um, 0.1-1 cm, 0.1-1 mm, 1-10 cm, 1-10 mm, or combinations thereof.

In some embodiments, the pellets are polystyrene pellets.

In some embodiments, the pellets have a diameter of about 1-10 millimeters.

In some embodiments, the interior is filled to a volume of about 40-85 percent with pellets.

In some embodiments, the pellets are free flowing within the interior.

In some embodiments, the chair includes at least one handle.

In some embodiments, the chair includes at least one clip.

In some embodiments, the presently disclosed subject matter is directed to a method of floating an object or person in a body of water. Specifically, the method comprises positioning a chair in the body of water. The chair includes a top panel and an opposed bottom panel, a pair of side panels that join the top and bottom panels, and a rear panel and an opposed front panel. The panels are joined together to define a fully enclosed chair with an interior, the interior filled with pellets. The front panel includes a portion of mesh defined by a series of apertures. The chair is buoyant and can float when in contact with a body of water. The method includes positioning the object or person on a top surface of the chair, whereby the object or person and the chair float in the body of water.

DETAILED DESCRIPTION

Figure 1:
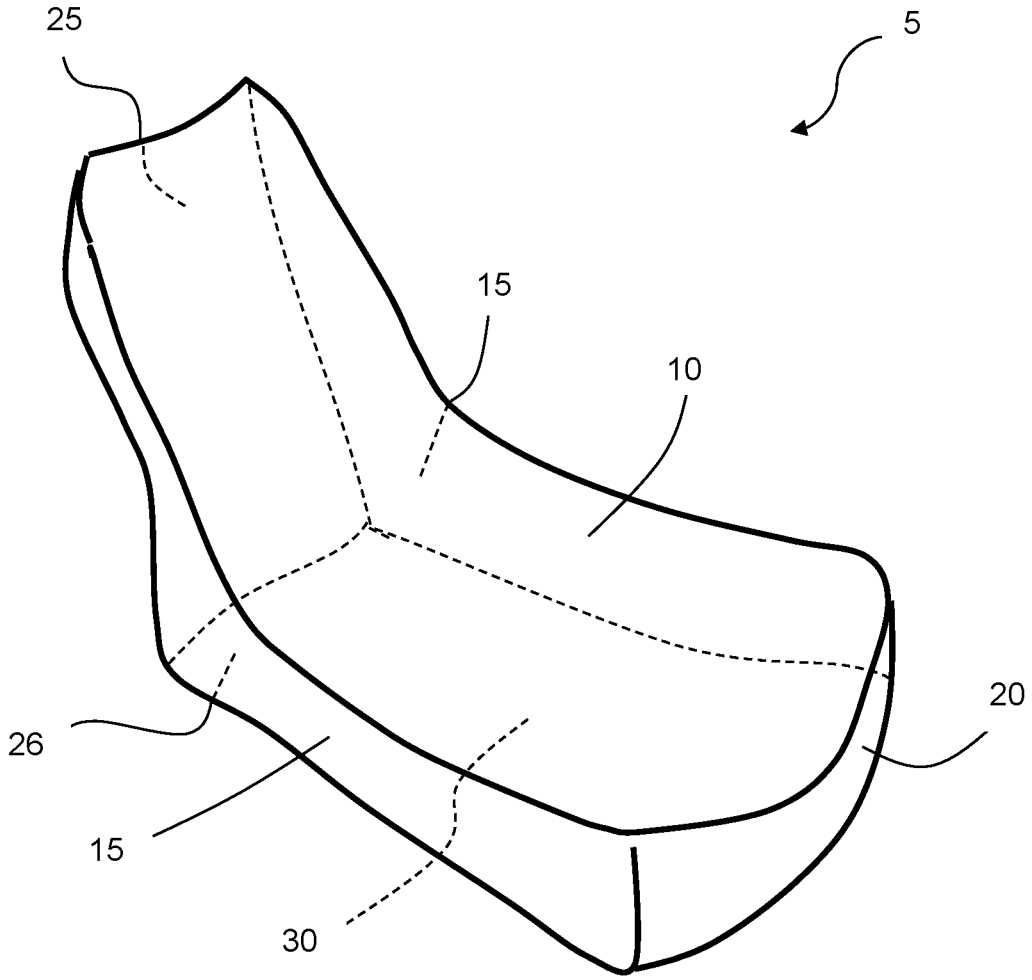
FIG. 1 is a perspective view of a chair in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to a chair (e.g., beanbag chair) that can be easily and securely used in a home and an aquatic environment. The term "beanbag chair" broadly refers to any chair filled with beans or beads that move in response to outside pressure (e.g., a sitters body weight). The term "bean" can refer to the genera of the flowering plant family Fabaceae (used as vegetables for food) and/or to any rounded or vegetable bean-shaped materials. The term "bead" broadly refers to any small objects configured in a variety of shapes and sizes, commonly formed from bone, shells, glass, plastic, wood, pearls, and the like. FIG. 1 illustrates one embodiment of chair 5 comprising top panel 10 that interacts directly with the user. Specifically, the top surface of the chair provides support for the user's back, rear end, and legs when in use. The chair also includes a pair of side panels 15, front panel 20, rear panel 25, and bottom panel 26. The chair includes interior 30 filled with one or more materials (e.g., polystyrene, beans, beads). Advantageously, the chair is constructed from one or more resilient materials, providing increased durability and comfort for the user. In addition, chair 5 is configured to float on a body of water, such as the ocean, a lake, a swimming pool, or a river.

Figure 2A:
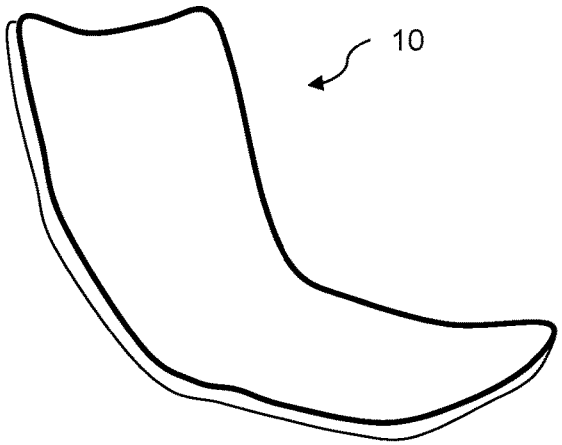
FIGS. 2*a* and 2*b* are perspective views of chair top panels in accordance with some embodiments of the presently disclosed subject matter.
Figure 2B:
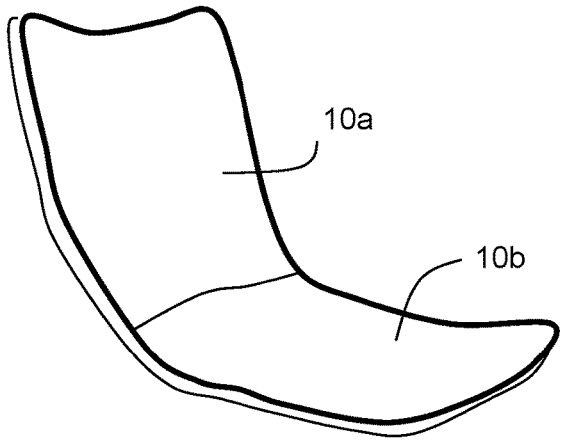

As set forth above, chair 5 includes top panel 10 that directly contacts the back, rear, and upper thighs, or legs of a user. In some embodiments, the top panel can be constructed as a single portion of material, as shown in FIG. 2*a*. Alternatively, the top panel (or any panel discussed herein) can include more than one portion of material (e.g., 10*a* and 10*b*), joined together as shown in the embodiment of FIG. 2*b*.

Top panel 10 can be constructed from any suitable material. For example, in some embodiments, the top panel can be constructed from soft material, providing comfort for the user. Thus, the top panel can be constructed from microfiber, cotton, nylon, polyester, wool, acetate, leather, fabric, blends thereof, or any other desired material. The term "microfiber" refers to synthetic or natural fiber having a minimum diameter in the range of about 10 microns to about 700 nanometers. The most common type of microfiber is made from polyesters, polyamides (nylon), and/or blends thereof. However, it should be appreciated that the top panel is not limited and can be constructed from any suitable material.

Figure 2C:
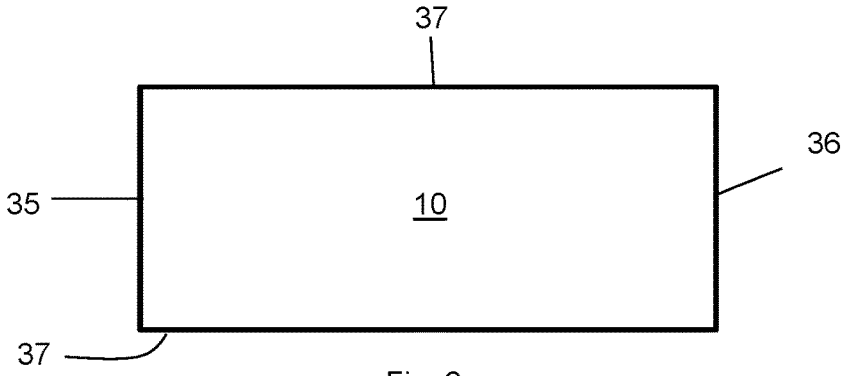
FIG. 2*c* is a top plan view of a chair top panel in accordance with some embodiments of the presently disclosed subject matter.
Figure 2D:
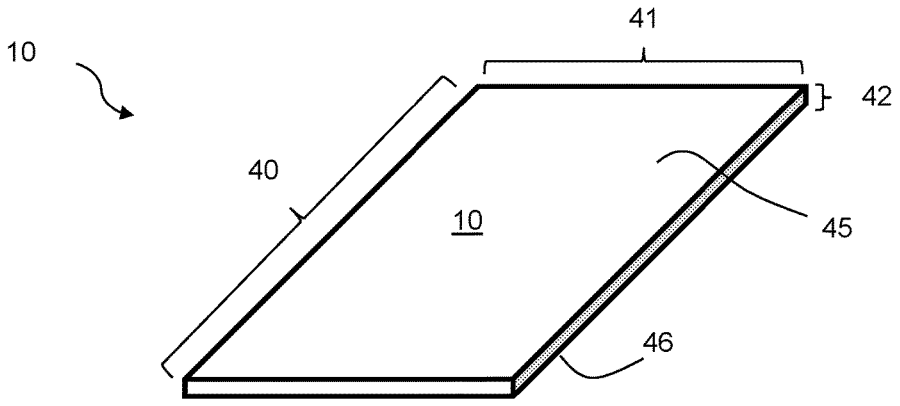
FIG. 2*d* is a perspective view of a chair top panel in accordance with some embodiments of the presently disclosed subject matter.

The top panel can have any desired shape, such as square, rectangular, oval, and the like. FIG. 2*c* illustrates one embodiment of top panel 10 in a lay flat orientation defined by first end 35, second end 36, and sides 37 that span the distance between the two ends. The top panel can include length 40, width 41, and thickness 42, as illustrated in FIG. 2*d*. The term "length" refers to the longest straight-line distance of the panel. The term "width" refers to the longest straight-line distance perpendicular to the length. The term "thickness" refers to the longest straight-line distance from top face 45 of the panel to opposed bottom face 46. In some embodiments, the length and/or width of the top panel can be about 1-10 feet (e.g., at least/no more than about 1, 2, 3, 4, 5, 6, 7, 8, 9, or 10 feet). In some embodiments, the thickness of the panel can be about 0.1-1 inches (e.g., at least/no more than about 0.1, 0.2, 0.3, 0.4, 0.5, 0.6, 0.7, 0.8, 0.9, or 1 inch). It should be appreciated that the dimensions of the top panel are not limited to the ranges given herein.

Figure 3A:
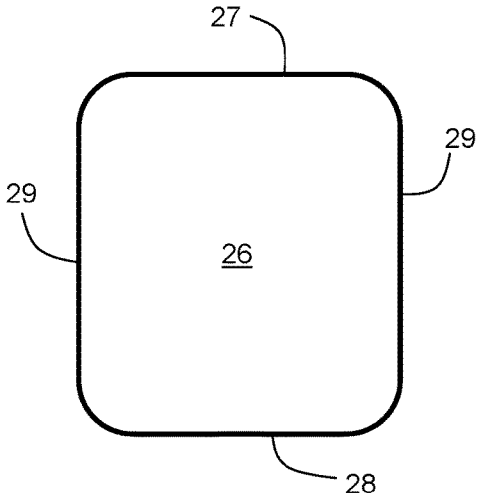
FIG. 3*a* is a top plan view of a chair bottom panel in accordance with some embodiments of the presently disclosed subject matter.
Figure 3B:
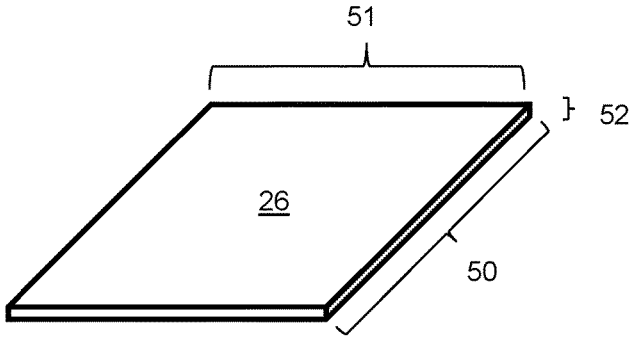
FIG. 3*b* is a perspective view of a chair bottom panel in accordance with some embodiments of the presently disclosed subject matter.

Chair 5 also includes bottom panel 26 that opposes top panel 10. In use, the bottom panel directly contacts a support surface (e.g., the floor, water), providing a reinforcement or foundation for the chair. FIGS. 3*a* and 3*b* illustrate one embodiment of the bottom panel, comprising top and bottom edges 27, 28 and a pair of side edges 29. The bottom panel also includes length 50, width 51, and thickness 52. In some embodiments, the length and/or width of the bottom panel can be about 1-10 feet (e.g., at least/no more than about 1, 2, 3, 4, 5, 6, 7, 8, 9, or 10 feet). In some embodiments, the thickness of the panel can be about 0.1-1 inches (e.g., at least/no more than about 0.1, 0.2, 0.3, 0.4, 0.5, 0.6, 0.7, 0.8, 0.9, or 1 inch). It should be appreciated that the dimensions and/or shape of the bottom panel are not limited to the ranges given herein.

Bottom panel 26 can be constructed from any suitable material, such as (but not limited to) one or durable materials. The term "durable" refers to a material that resists wear, decay, and damage compared to conventional materials. Suitable durable materials include Cordura®, nylon, canvas, polyester, Teflon®, polyamide, plastic, or combinations thereof. The durability of the material provides resistance against inadvertent contact with objects or people during use. In some embodiments, the material used to construct the bottom panel can be fully or partially porous. The term "porous" refers to a material that includes pores (e.g., micropores, nanopores, mesopores, and the like). The porous nature of the material contributes to the buoyancy of chair 5 as discussed in detail below. "Fully porous" refers to the characteristic of being about 100% porous. "Partially porous" refers to the characteristic of being at least/no more than about 10, 15, 20, 25, 30, 35, 40, 45, 50, 55, 60, 65, 70, 75, 80, 85, 90, or 95 percent porous.

Although depicted as rectangular in shape in FIGS. 3*a* and 3*b*, bottom panel 26 can be configured in any desired shape (e.g., square, round, oval, triangular, octagonal).

Figure 4A:
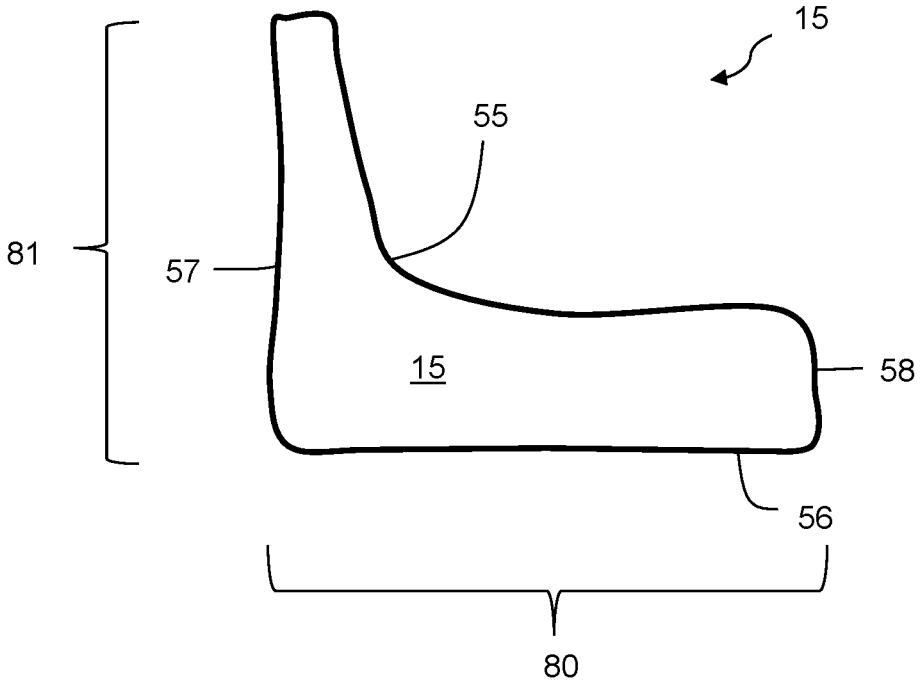
FIG. 4*a* is a side plan view of a chair side panel in accordance with some embodiments of the presently disclosed subject matter.

Chair 5 also includes a pair of side panels 15 that span the distance between the top panel and the bottom panel. FIG. 4*a* illustrates one embodiment of side panel 15 defined by upper edge 55 and opposed lower edge 56 joined by rear side edge 57 and front side edge 58. The upper edge of each side panel is joined to a side edge of a corresponding top panel. Similarly, lower edge 56 of each side panel is joined to a side edge of bottom panel 26. The panels can be joined together using any suitable technique, such as sewing, adhesive, heat sealing, VELCRO®, mechanical closures (e.g., fasteners, snaps, zippers, buttons, clips, clasps).

Figure 4B:
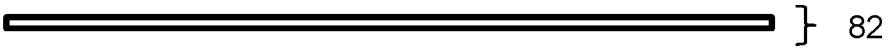
FIG. 4*b* is a front plan view of a chair side panel in accordance with some embodiments of the presently disclosed subject matter.

In some embodiments, each side panel can include length 80 or width 81 of about 1-10 feet (e.g., at least/no more than about 1, 2, 3, 4, 5, 6, 7, 8, 9, or 10 feet). The side panel can further include thickness 82 of about 0.1-1 inch (0.1, 0.2, 0.3, 0.4, 0.5, 0.6, 0.7, 0.8, 0.9, or 1 inch), as shown in FIG. 4*b*.

Side panels 15 can be constructed from any durable material such as (but not limited to) Cordura®, nylon, canvas, polyester, Teflon®, polyamide, plastic, or combinations thereof.

It should be appreciated that side panels 15 can have the elongated shape shown in FIG. 4*a*. However, the shape of the side panels is not limited and can have any desired shape.

Figure 5A:
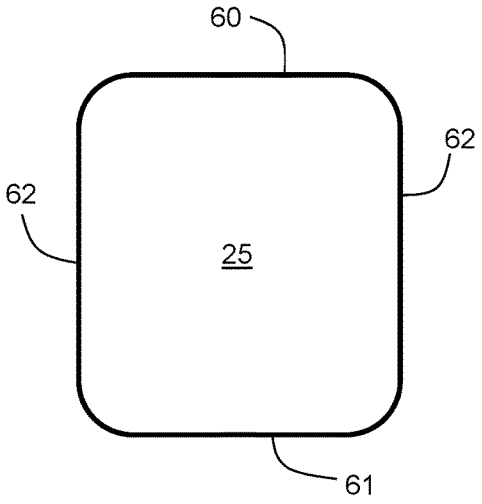
FIG. 5*a* is a top plan view of a chair rear panel in accordance with some embodiments of the presently disclosed subject matter.
Figure 5B:
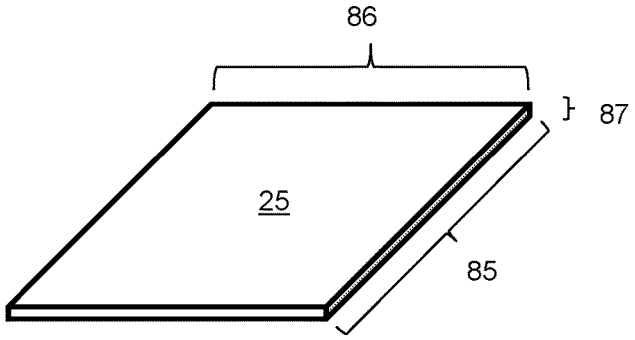
FIG. 5*b* is a perspective view of a chair rear panel in accordance with some embodiments of the presently disclosed subject matter.

Chair 5 includes rear panel 25 which makes up the rear face of the chair, as illustrated in FIGS. 5*a* and 5*b*. The rear panel includes top edge 60 and opposed bottom edge 61 joined by side edges 62. The top edge of the rear panel joins to top edge 35 of top panel 10. Bottom edge 61 of the rear panel joins top edge 28 of the bottom panel. The side edges of the rear panel join with rear side edges 57 of each side panel 15. The panels can be joined using any suitable method, such as sewing, adhesive, VELCRO®, heat sealing, mechanical closures, and the like.

The rear panel can include length 85 and/or width 86 of about 1-10 feet (e.g., at least/no more than about 1, 2, 3, 4, 5, 6, 7, 8, 9, or 10 feet). The rear panel can further include thickness 87 of about 0.1-1 inch (0.1, 0.2, 0.3, 0.4, 0.5, 0.6, 0.7, 0.8, 0.9, or 1 inch), as shown in FIG. 5*b*. However, it should be appreciated that the dimensions of the panels are not limited to the ranges set forth herein.

The rear panel can be constructed from any suitable material such as (but not limited to) Cordura®, nylon, canvas, polyester, Teflon®, polyamide, plastic, or combinations thereof.

Figure 6A:
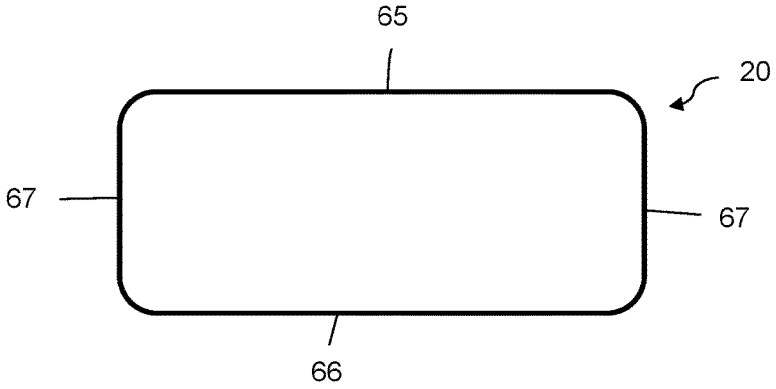
FIG. 6*a* is a top plan view of a chair front panel in accordance with some embodiments of the presently disclosed subject matter.

Chair 5 comprises front panel 20 defined by top edge 65, opposed bottom edge 66, and a pair of side edges 67, as illustrated in FIG. 6*a*. The upper edge of the front panel is joined to second edge 36 of the top panel. Lower edge 37 of the front panel is joined to bottom edge 28 of the bottom panel. Side edges 29 of the front panel are joined to the front side edges 58 of a corresponding side panel. The panels can be joined together using any suitable technique, such as sewing, adhesive, heat sealing, VELCRO®, mechanical closures (e.g., fasteners, snaps, zippers, buttons, clips, clasps).

Figure 6B:
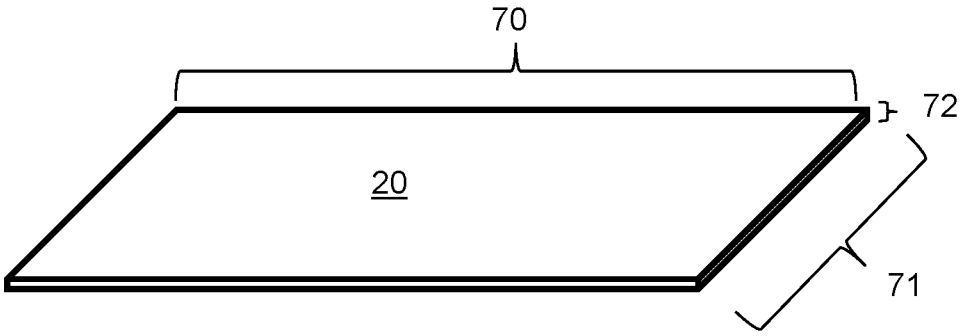
FIG. 6*b* is a perspective view of a chair front panel in accordance with some embodiments of the presently disclosed subject matter.

The front panel can include length 70 and/or width 71 of about 1-10 feet (e.g., at least/no more than about 1, 2, 3, 4, 5, 6, 7, 8, 9, or 10 feet), as shown in FIG. 6*b*. The front panel also includes thickness 72 of about 0.1-1 inch (e.g., at least/no more than about 0.1, 0.2, 0.3, 0.4, 0.5, 0.6, 0.7, 0.8, 0.9, or 1 inch).

Figure 6C:
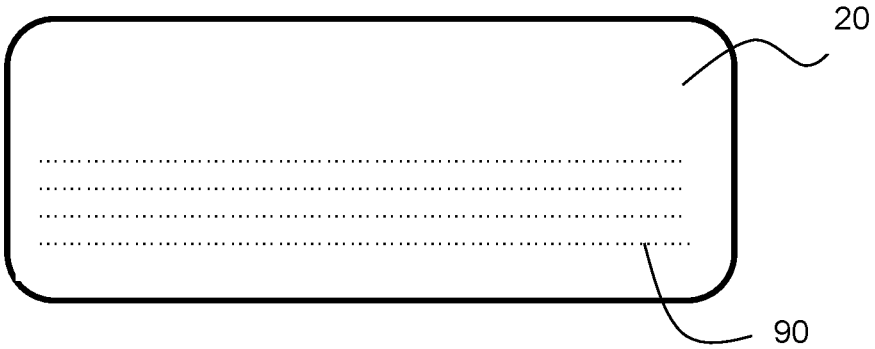
FIG. 6*c* is a top plan view of a chair front panel comprising a portion of mesh in accordance with some embodiments of the presently disclosed subject matter.

In some embodiments, the front panel can include a portion of mesh material 90, as shown in FIG. 6*c*. The term "mesh" broadly refers to any material that includes one or more apertures sized to allow fluid to pass through. The mesh material can therefore include one or more apertures that allow water to drain from the interior of the chair during and after use. In this way, the chair remains buoyant and excess water is allowed to drain from the chair interior. The mesh apertures can have any suitable size, such as with a diameter of about 50-500 um, 0.1-1 cm, 0.1-1 mm, 1-10 cm, 1-10 mm, or combinations thereof.

Figure 6D:
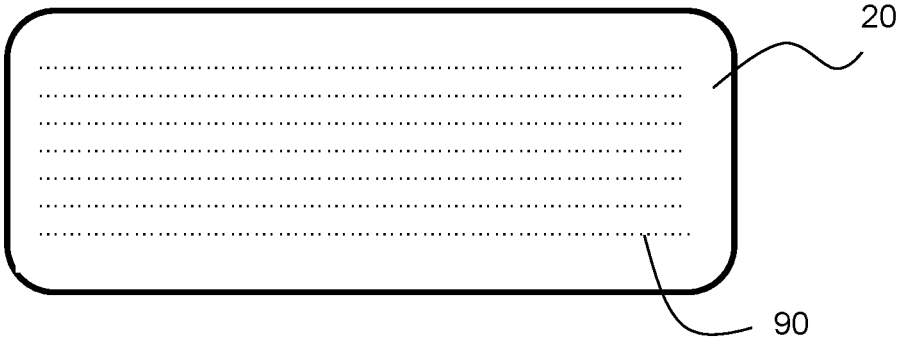
FIG. 6*d* is a top plan view of a chair front panel comprising a portion of mesh in accordance with some embodiments of the presently disclosed subject matter.

The portion mesh material can have any suitable size, such as a length and/or width of about 1-10 feet (e.g., at least/no more than about 1, 2, 3, 4, 5, 6, 7, 8, 9, or 10 feet). In some embodiments, the mesh material makes up about 100% of the front panel, as shown in FIG. 6*d*. In other embodiments, the mesh material, makes up about 50-99% of the front panel (e.g., at least/no more than about 50, 55, 60, 65, 70, 75, 80, 85, 90, 95, or 99%).

Front panel 20 can be constructed from any suitable material, such as (but not limited to) microfiber, cotton, nylon, polyester, wool, acetate, blends thereof, or any other desired material.

The front panel can have any suitable shape, such as (but not limited to) square, rectangular, oval, and the like.

It should be appreciated that instead of having individual panels as described herein, some panels can be constructed as a single unit. For example, the front and bottom panels can be constructed as a single unit. Any adjacent panels can be created as a single unit.

Figure 7:
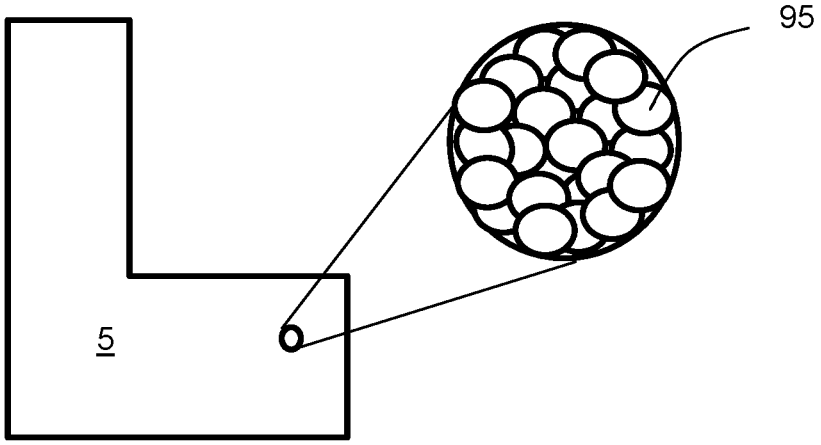
FIG. 7 is a side plan view of a chair with an inset of the interior in accordance with some embodiments of the presently disclosed subject matter.

The panels are joined together to create a closed chair comprising interior 30. The chair interior can be filled or partially filled with any suitable material. For example, the chair interior can be at least partially filled with polystyrene filling. The polystyrene filling can take the form of generally spherical pellets 95, as shown in FIG. 7. The pellets can have any desired shape, such as oval, rounded, circular, oblong, and the like. Similarly, the pellets can have any suitable size, such as about 1-10 millimeters in diameter, although the pellets can be larger or smaller than the given range. The term "diameter" refers to a straight line passing from side to side through the center of a cross-section of the pellet. Thus, the pellets can be configured in any desired size or shape.

The interior of chair 5 can be fully filled (e.g., about 95-100 percent of the internal volume of the chair is filled). In other embodiments, the chair is partially filled to create a softer and more comfortable sitting chair. The term "partially filled" refers to filling the internal volume of the chair to about 40-85 percent (e.g., at least/no more than about 40, 45, 50, 55, 60, 65, 70, 75, 80, 85 percent). By partially filling the internal volume 30, the chair has a self-shaping design, fitting around the user's body and making its own backrest.

When chair 5 is subjected to pressure, the pellets are able to flow and redistribute themselves (similar to a fluid). Thus, when a user sits onto the top panel of chair 5, pellets 95 are displaced from the volume of space occupied by the user's body and flow into unoccupied portions with the chair interior. The flow and redistribution of the pellets enable chair 5 to both conform to the contours of the user's body (in whatever position is assumed) and to provide support to the user's body, creating a comfortable sitting experience. As a result, the chair customizes to the user's particular body size and shape, increasing comfort. In some embodiments, the chair can include a backrest that supports the user's back, shoulders, and/or neck and head.

Figure 8A:
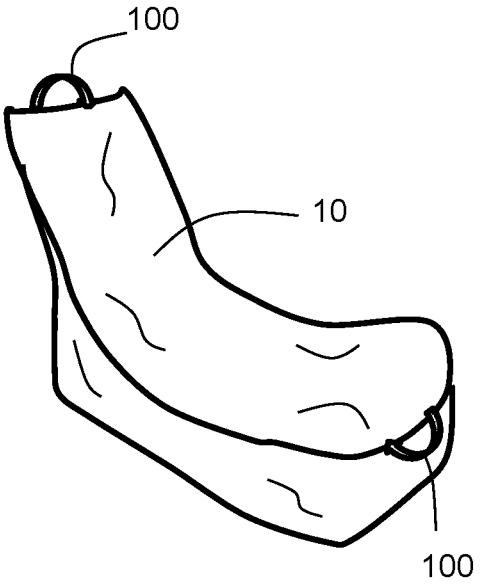
FIGS. 8*a* and 8*b* are perspective views of chairs configured with handles in accordance with some embodiments of the presently disclosed subject matter.
Figure 8B:
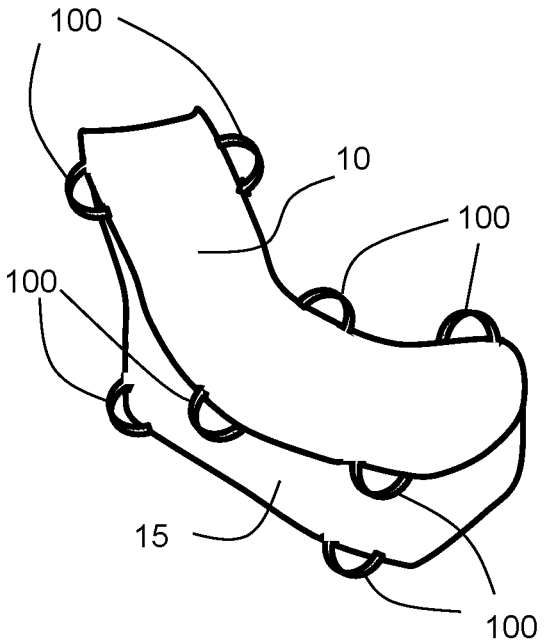

Optionally, chair 5 can include one or more handles positioned at a desired location. The term "handle" broadly refers to any element that the user can grip or otherwise manipulate to guide, lift, or position the chair. For example, the chair can include handle 100 positioned at a top and/or bottom surface of the chair, as shown in FIG. 8*a*. Alternatively or in addition, the chair can include one or more handles 100 positioned on or adjacent to side panels 15 and/or the front/rear panels, as shown in FIG. 8*b*. The handles allow the chair to be easily lifted and moved as desired by the user. It should be appreciated that the handles are optional, and the chair can be configured to be handle-free.

Figure 9:
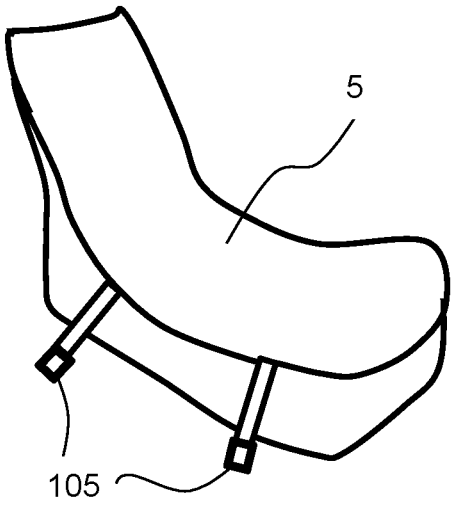
FIG. 9 is a perspective view illustrating a chair comprising a strap in accordance with some embodiments of the presently disclosed subject matter.

Optionally, chair 5 can include one or more clips 105 positioned at a desired location. The term "clip" broadly refers to any element that allows for attachment of another chair or item. For example, the chair can include clip 105 positioned at a top and/or bottom surface of the chair, as shown in FIG. 9. Alternatively or in addition, the chair can include one or more clips 105 positioned on or adjacent to any panel of the chair. The clip allows the chair to be removably attached to another chair or item (e.g., cooler, raft, backpack, etc.). It should be appreciated that the clips are optional, and the chair can be configured to be clip-free.

In use, the chair can comfortably be used in a wide variety of environments. For example, the chair can be used within the home, providing a comfortable seating option for users. The durable materials also protect chair 5, ensuring that chair resists damage from normal wear and tear, children playing, spills, and contact with other items.

If desired, the chair 5 can also be used in an aquatic environment. The term "aquatic environment" refers to any environment that includes water, such as rivers, streams, ocean, lakes, swimming pools, and the like. Advantageously, chair 5 is buoyant when placed in water. The term "buoyant" refers to the characteristic of an item to float in a fluid. Thus, when placed in a lake or other body of water, the chair will float. As a result, the user can enjoy the comfort of chair 5 even when at the beach. The interior material (e.g., polystyrene beads, beans, and/or beads) add to the buoyant characteristic of the chair, ensuring that all or a portion of the chair remains above the water level. In addition, mesh 90 allows water to drain from the interior of the chair, ensuring that the chair remains buoyant and does not become waterlogged and sink. Stated another way, the mesh allows for the free flow of water into and out of the chair, which promotes floating of the chair. Even under the weight of a user sitting on top panel 10, the chair remains buoyant and allows the user to enjoy the comfort of the chair while floating in the water.

The disclosed chair can provide many advantages over prior art beanbag chairs. For example, 5 can be used as a conventional chair in a first environment (e.g., within the home, on a boat, on a patio) and also can be used in an aquatic environment (e.g., the ocean, lake, swimming pool). The versatility of the disclosed chair broadens its appeal and usability.

The disclosed chair is buoyant and floats when exposed to water. As a result, the chair floats and does not sink, even when a user is positioned on the top panel.

Chair 5 is easy to use, allowing even the elderly or children to comfortably sit for extended periods of time.

The disclosed chair is lightweight, weighing less than about 30 pounds. As such, the chair can be easily moved from one location to another when desired.

The disclosed chair is attractive and can be customized in a variety of colors and patterns.

Chair 5 is durable due at least in part to the materials selected for the panels, such that it will last many years.

Exemplary embodiments of the methods and components of the presently disclosed subject matter have been described herein. As noted elsewhere, these embodiments have been described for illustrative purposes only, and are not limiting. Other embodiments are possible and are covered by the presently disclosed subject matter. Such embodiments will be apparent to persons skilled in the relevant art(s) based on the teachings contained herein. Thus, the breadth and scope of the present invention should not be limited by any of the above-described exemplary embodiments but should be defined only in accordance with the following claims and their equivalents.

What is claimed is:

1. A chair comprising:

a top panel and an opposed bottom panel;

a pair of side panels that join the top panel and opposed bottom panel;

a rear panel and an opposed front panel;

wherein the top panel, the opposed bottom panel, the pair of side panels are joined together to define a fully enclosed chair with an interior, the interior filled with pellets;

wherein the opposed front panel includes a portion of mesh defined by a series of apertures;

wherein the chair is buoyant and floats when in contact with a body of water; and wherein the opposed front panel comprises a porous portion and a non-porous portion.

2. The chair of claim 1, wherein the chair is a beanbag chair.

3. The chair of claim 1, wherein the top panel is configured to contact a users body.

4. The chair of claim 1, wherein the top panel and the opposed front panel are constructed from microfiber, cotton, nylon, polyester, wool, acetate, blends thereof.

5. The chair of claim 1, wherein the top panel has a rectangular shape.

6. The chair of claim 1, wherein each of the top panel, the opposed bottom panel, and the pair of side panels has a length of about 1-10 feet, a width of about 1-10 feet, and a thickness of about 0.1-1 inch.

7. The chair of claim 1, wherein the opposed bottom panel, rear panel, and the pair of side panels are constructed from Cordura®, nylon, canvas, polyester, Teflon®, polyamide, plastic, or combinations thereof.

8. The chair of claim 1, wherein the series of apertures have a diameter of about 50-500 um, 0.1-1 cm, 0.1-1 mm, 1-10 cm, 1-10 mm, or combinations thereof.

9. The chair of claim 1, wherein the pellets are polystyrene pellets.

10. The chair of claim 1, wherein the pellets have a diameter of about 1-10 millimeters.

11. The chair of claim 1, wherein the interior is filled to a volume of about 40-85 percent with pellets.

12. The chair of claim 1, wherein the pellets are free flowing within the interior.

13. The chair of claim 1, further comprising at least one handle, a clip, or both.

14. The chair of claim 1, wherein the opposed bottom panel is fully porous.

15. A method of floating an object or person in a body of water, the method comprising:

positioning a chair in the body of water, the chair defined as:

a top panel and an opposed bottom panel;

a pair of side panels that join the top panel and opposed bottom panel;

a rear panel and an opposed front panel;

wherein the top panel, the opposed bottom panel, and the pair of side panels are joined together to define a fully enclosed chair with an interior, the interior filled with pellets;

wherein the opposed front panel includes a portion of mesh defined by a series of apertures;

wherein the chair is buoyant and can float when in contact with a body of water;

positioning the object or person on a top surface of the chair;

whereby the object or person and the chair float in the body of water; and wherein the opposed front panel comprises a porous portion and a non-porous portion.

16. The method of claim 15, wherein the chair is a beanbag chair.

17. The method of claim 15, wherein the top panel and the opposed front panel are constructed from microfiber, cotton, nylon, polyester, wool, acetate, blends thereof.

18. The method of claim 15, wherein the opposed bottom panel, rear panel, and the pair of side panels are constructed from Cordura®, nylon, canvas, polyester, Teflon®, polyamide, plastic, or combinations thereof.

19. The method of claim 15, wherein the chair interior is filled to a volume of about 40-85 percent with pellets.

20. The method of claim 15, wherein the opposed bottom panel is fully porous.

* * * * *